US005904162A

United States Patent [19]

Ferguson et al.

[11] Patent Number: 5,904,162

[45] Date of Patent: May 18, 1999

[54] REMOVABLE WAREWASHING APPARATUS

[75] Inventors: Mark A. Ferguson; Dwayne A. Becknell, both of Barbourville, Ky.; Daniel F. Brady, High Point, N.C.; Martin D. Schenk, Nashville, Tenn.

[73] Assignee: Ecolab Inc., St.Paul, Minn.

[21] Appl. No.: 09/140,115

[22] Filed: Aug. 25, 1998

[51] Int. Cl.[6] ..... B08B 9/42; B08B 9/44

[52] U.S. Cl. ..... 134/25.2; 134/25.1; 134/133; 134/137; 134/165; 134/201

[58] Field of Search ..... 134/25.1, 25.2, 134/109, 133, 137, 165, 200, 201, 32; 248/128, 129

[56] References Cited

U.S. PATENT DOCUMENTS

| | | | |
|---|---|---|---|
| 2,947,311 | 8/1960 | Fox et al. | 134/58 D |
| 3,498,304 | 3/1970 | Rumbaugh | 134/58 D |
| 4,744,379 | 5/1988 | Goettel | 134/109 |
| 5,259,889 | 11/1993 | Payzant | 134/15 |
| 5,501,742 | 3/1996 | Fernholtz | 134/25.2 |
| 5,507,877 | 4/1996 | Magsisg et al. | 134/18 |

*Primary Examiner*—Lyle A. Alexander
*Assistant Examiner*—Alexander Markoff
*Attorney, Agent, or Firm*—Merchant, Gould, Smith, Edell, Welter & Schmidt, P.A.

[57] ABSTRACT

Disclosed is a warewashing assembly comprising a batch-loading warewashing machine and a movable tray or cart capable of holding a rack in a position that departs form the horizontal outside of the warewashing machine for convenient operations; said tray or cart comprising a flat tray of a size complementary to said rack, wherein the flat tray comprises side and rear fences capable of holding the ware rack against horizontal motion and wherein the tray is attached to a support structure in such a way that it is supported at the desired angle α and can be inserted into the machine when quiescent; wherein the support structure is of a height approximately equal to that of the warewashing machine and comprises means to move horizontally in relation to the warewashing machine.

4 Claims, 4 Drawing Sheets

REMOVABLE WAREWASHING APPARATUS

FIELD OF THE INVENTION

The invention relates generally to equipment for use with commercial warewashing machines and more specifically to smaller single chamber warewashing machines commonly used in smaller commercial kitchens and food preparation areas. The invention involves a combination of a sloped or angle adapted cart or table and a warewashing machine. The cart or table comprises a movable cart or table with a defined surface angle that depatrs form the horizontal which can be used to support a objects or articles used in conjunction with the machine. One important object is a rack, made of wire or molded plastic, placed on the cart or table outside of the warewashing machine for ease of loading unloading and movement into and out of the machine.

BACKGROUND OF THE INVENTION

Stringent hygiene requirements for commercial kitchens and food preparation areas have resulted in the widespread use of commercial warewashing machines. In smaller commercial kitchens, these are generally batch loading high temperature or low temperature machines capable of cleaning a single rack of dishes, glasses and silverware at a time. Since it is difficult to load such a rack while within the warewashing machine, most users place the machine proximate to cabinet, kitchen counter or fixed work stations in the use environment. Unfortunately, this requires space for the machine which may be at a premium in smaller establishments. Some kitchens will build-in, or incorporate into the kitchen, a permanent prewash spray station and sink into a table or counter that can act to hold objects for insertion into the machine or can support hot objects recently removed. This enables a user to remove excess food debris from the ware prior to wash and to permit handling of hot or wet ware. This spray station can also comprise a garbage disposal to handle the food debris. While beneficial, such an arrangement consumes valuable space which may not be available.

An alternative for such permanent installations are needed. Smaller dishwashers suitable for home use slidable racks which are mounted on slides or wheeled brackets. This permits the rack to be slid outward for easy loading while still supporting the rack. Once loaded, the rack can be slid back into the dishwasher so that the dishes and other ware contained therein can be washed. Larger commercial warewashing machines lack this ability, since they generally utilize a plurality of wire or molded racks. This permits one or more racks to be loaded while one rack is being washed and one or more racks are drying and cooling.

Accordingly, a need remains for a warewashing machine with a device capable of holding a ware rack for convenient loading without consuming excessive space when not in use. Such a device should be easily inserted into the warewashing machine in order to consume minimal space while the tray and machine are not in use.

SUMMARY OF THE INVENTION

Accordingly, the invention is found in a warewashing assembly comprising a batch-loading warewashing machine and an attached table or cart with a top portion or surface held at an angle that departs form the horizontal by about 5° to 15° towards the machine washing chamber. This angle or intentional slope permits ease of loading and unlaoding and causes any liquid on the tray to drain into the machine. The invention also comprises a method of use of the machine in which the table or cart is attached to the machine and an object is inserted or withdrawn from the machine using the table as a support. The table is capable of holding an object or objects such as a wire or molded plastic ware rack in a convenient position outside of the warewashing machine for loading or unloading. Said cart comprising a flat tray of a size complementary to or larger than said ware rack, wherein the flat tray comprises side and rear fences capable of holding the ware rack against substantially horizontal motion and wherein the tray is attached to a support structure in such a way that the tray is held at the desired angle; wherein the support structure is of a suitable height to permit ready interaction of the tray with the warewashing machine and comprises means to move horizontally in relation to the warewashing machine. The tray is configured to attach to and be supported by the machine.

DETAILED DESCRIPTION OF THE FIGURES

Figure 1:
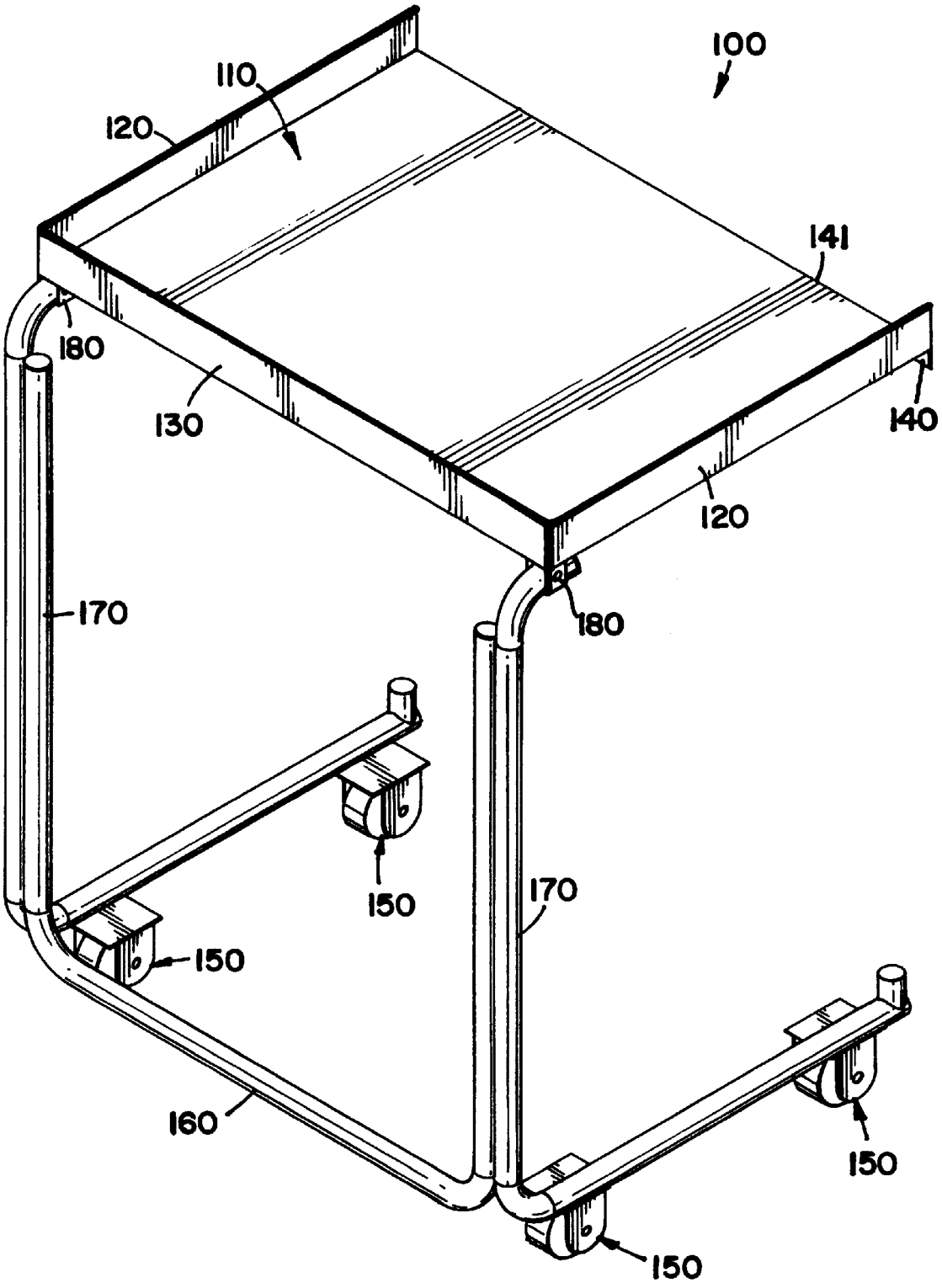
FIG. 1 is a perspective view of a tray or cart suitable for holding a ware rack for loading.

FIG. 1 is a perspective view of the cart 100 of the invention that can be used with a warewashing machine. Shown is a tray top 110 of a size and shape suitable to hold a ware rack for loading purposes that is sloped at an angle towards the machine (see FIG. 2 for the machine and angle). Also seen are side fences 120 and rear fence 130, which serve to keep an object such as the ware rack (not shown) from sliding off of the support means in an unintended direction. The fourth side of the tray top 110 comprises an edge 141 flush with the tray 110 and a lip 140 which can rest on a complementary surface on the warewashing machine (see FIG. 2 for the complementary surface not seen in this Figure). Said complementary surface comprises a linear structure that matches the lip and provides support along the entire length of the lip 140 and edge 141.

The tray top 110 is attached to the remainder of the cart via a support hinge means 180. Support 180 is mechanically sufficient to maintain the table surface at an angle between 5° and 15°, preferably 6° to 12°. In an alternative embodiment (not seen), the hinge apparatus can comprise a ratcheting mechanism which allows the tray 110 to be supported at the desired angle or position without resting on the side of the warewashing machine. Another alternative (not shown) would be the use of the simple hinge arrangement shown in the Figure along with the simultaneous use of braces running from the L-shaped supports 170 to the side fences 120 to form the angled surface. These braces would have detents suitable to hold the tray top 110 in a use position. In this instance, the cart could be used to hold a ware rack anywhere in a kitchen, rather than being limited to placement immediately adjacent the warewashing machine. The ware rack can be brought to the dirty ware, rather than the other way around. The cart could also be used to hold a rack of cooling and drying ware, since it could easily be used on either side of the warewashing machine. Further, a rack of clean ware can be withdrawn from either side of the warewashing machine.

The remainder of the cart comprises a vertically orientated U-shaped support structure 160 and a pair of L-shaped support structures 170. These members can be attached to one another by any means known in the art, such as welding, crimping or the use of adhesives. Means to move the structure horizontally along the floor is provided by the caster assemblies 150, which can comprise any reasonably sized wheel or caster known to one of skill in the art.

The cart itself is preferably made of enameled metal, aluminum or stainless steel, as are most commercial sinks, counters and warewashing machines. Assembly of the cart itself provides some opportunities for variation. The embodiments shown use pieces of tubular stainless steel joined with elbow brackets. Alternatively, the U-shaped support structure 160 could be bent from a single piece of stainless steel, as could each L-shaped support structure 170. As another option, individual straight pieces of tubular or solid stainless steel could be welded together to form the required structures. These decisions are well within the skill of one in the art.

Figure 2:
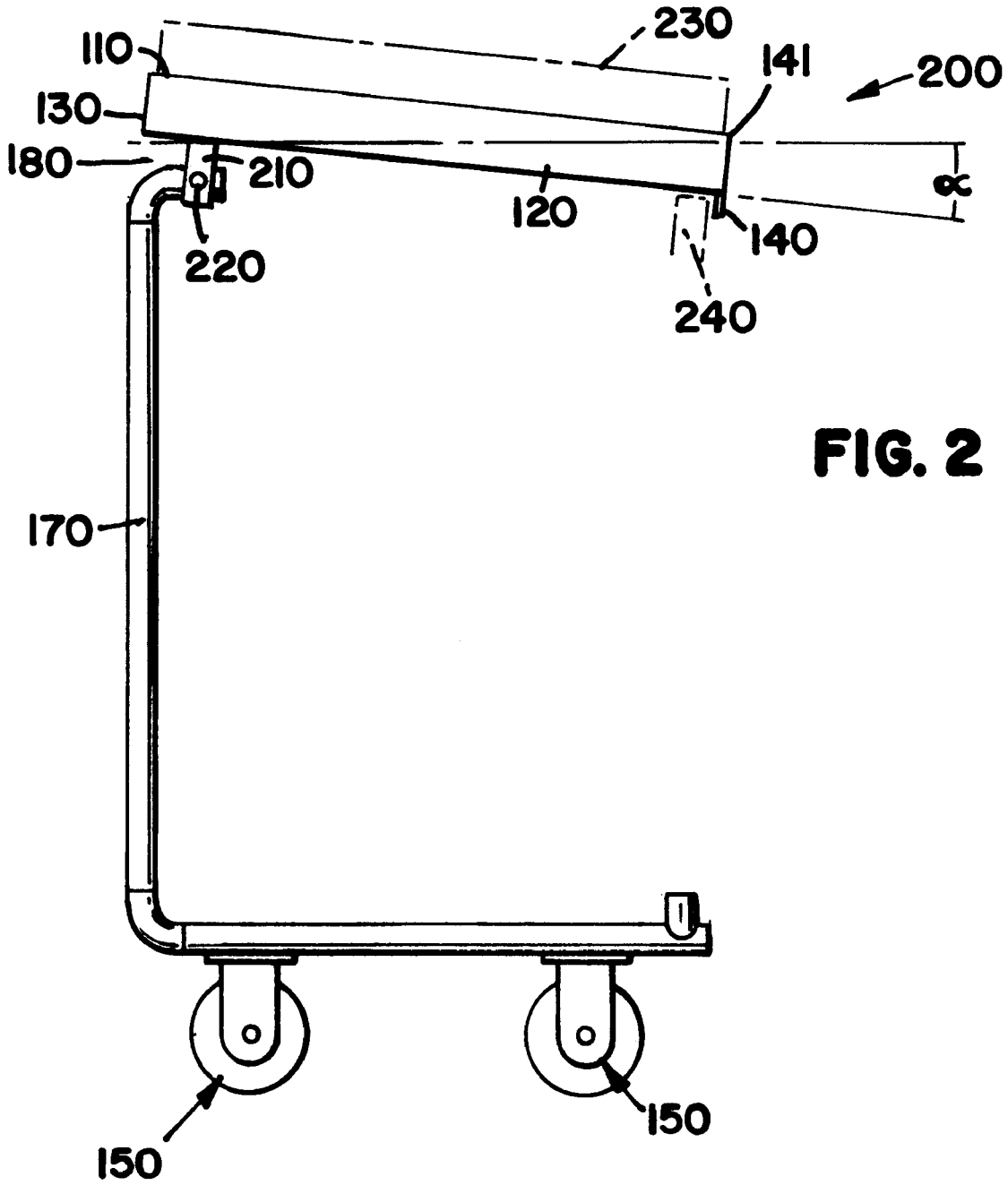
FIG. 2 is a side elevation of the structure shown in FIG. 1.

FIG. 2 is a side elevation view of the cart 200 of the invention with the tray surface 110 at an angle α that is between 5° and 15°, preferably 6° to 12°. As before, a tray top 110, side fences 120 and rear fence 130 are seen. A rack 230 (in phantom) is shown on the tray 110. The fourth side of the tray top 110 comprises a lip 140 which can rest on a support 240 of the warewashing machine (shown in phantom). The tray top 110 is attached to the remainder of the cart via a hinge apparatus 180. In this particular embodiment, the hinge apparatus 180 comprises a hinge upright 210 which is held in place by the tube 170 and hinge pin 220. As before, caster assemblies 150 can comprise any reasonably sized wheel or caster known to one of skill in the art.

Figure 3:
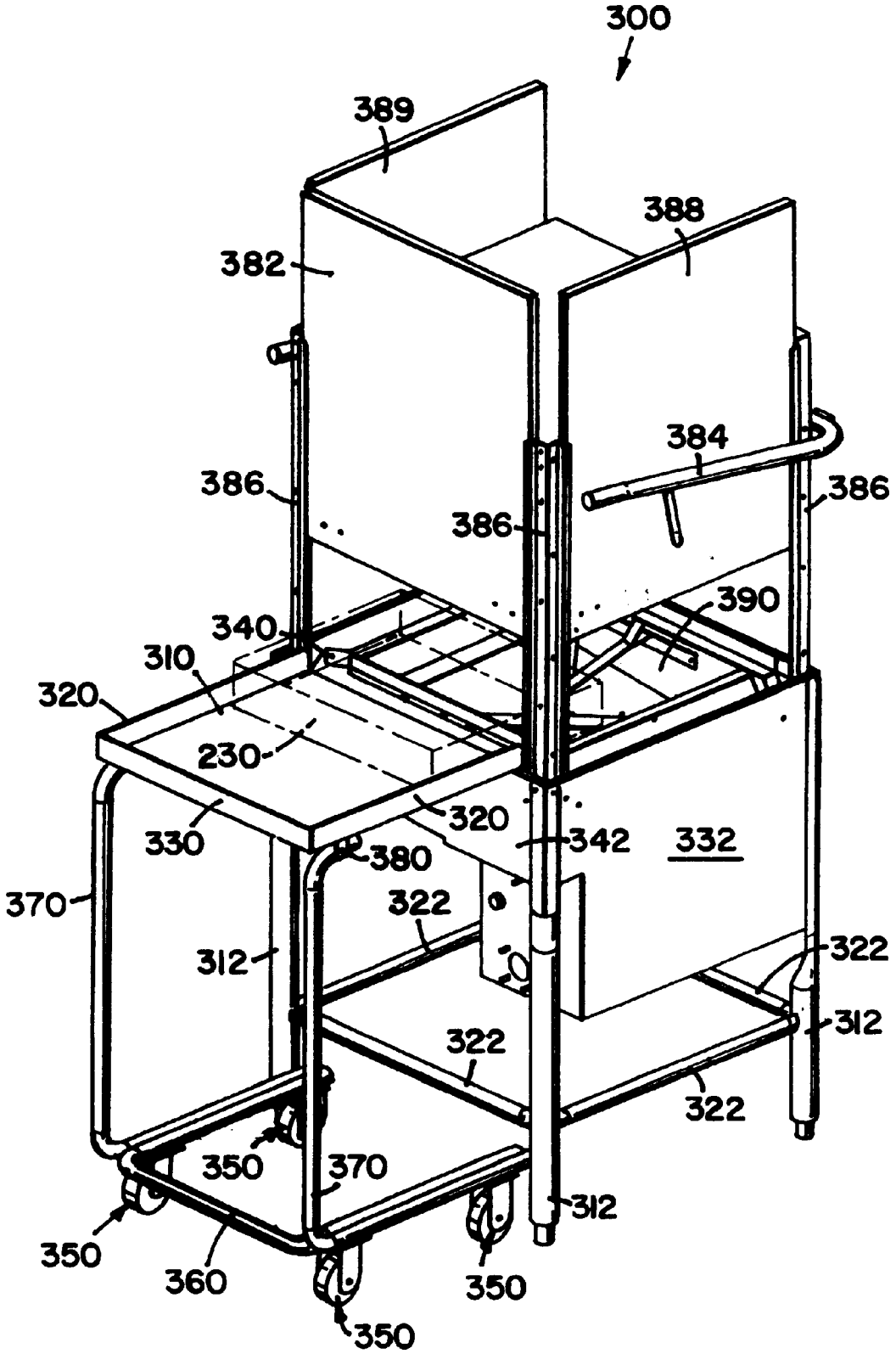
FIG. 3 is a perspective view of the invention showing the warewashing machine in combination with the tray or cart of FIGS. 1 and 2. In this Figure, the cart is shown in a loading mode. The warewashing machine can be run with the cart in this position once the ware rack is slid into the warewashing machine.

FIG. 3 is a perspective view of the warewashing assembly 300 of the invention, in which the cart is seen in a loading mode at an angle α of about 9°. The support structure shown in this Figure differs somewhat from that shown in the previous Figures. Seen is a tray top 310, which has side fences 320, rear fence 330 and front lip 340. The tray top is attached to the remainder of the support structure via hinge assemblies 380 to the L-shaped support structures 370. A object 230 (in phantom) such as a rack is shown partially inserted or partially withdrawn from the washing chamber 390 of the machine 300. The remaining element of the support structure is horizontally orientated U-shaped support structure 360. By contrast, the corresponding structural element in FIGS. 1 and 2 is vertically orientated. The cart is made mobile by the addition of caster assemblies 350.

Also seen in this Figure is a batch loading warewashing machine, such as a low temperature Hobart machine. While the cart is the key of the invention, certain portions of the warewashing machine should be noted. The cart is of a height about but not exactly equal to that of side panel 342 and front panel 332, allowing front lip 340 to rest on the warewashing machine. Also seen are a side door 382, back door 389 and front door 388, which also comprises a door lift handle 384. These doors, together with the side panel 342, front panel 332 and door supports 386 define the aperture through which ware racks must be placed when loaded into the washing chamber 390. The location of this aperture defines a suitable height for the cart and also cooperates to fix the angle α of the tray top 310.

Another important feature of the warewashing machine involves its supports. Specifically, warewasher legs 312 and horizontal braces 322 cooperate to provide a space into which the cart can be inserted when not in use in order to conserve space. In this Figure, though, the cart is pictured in a loading or use mode.

Figure 4:
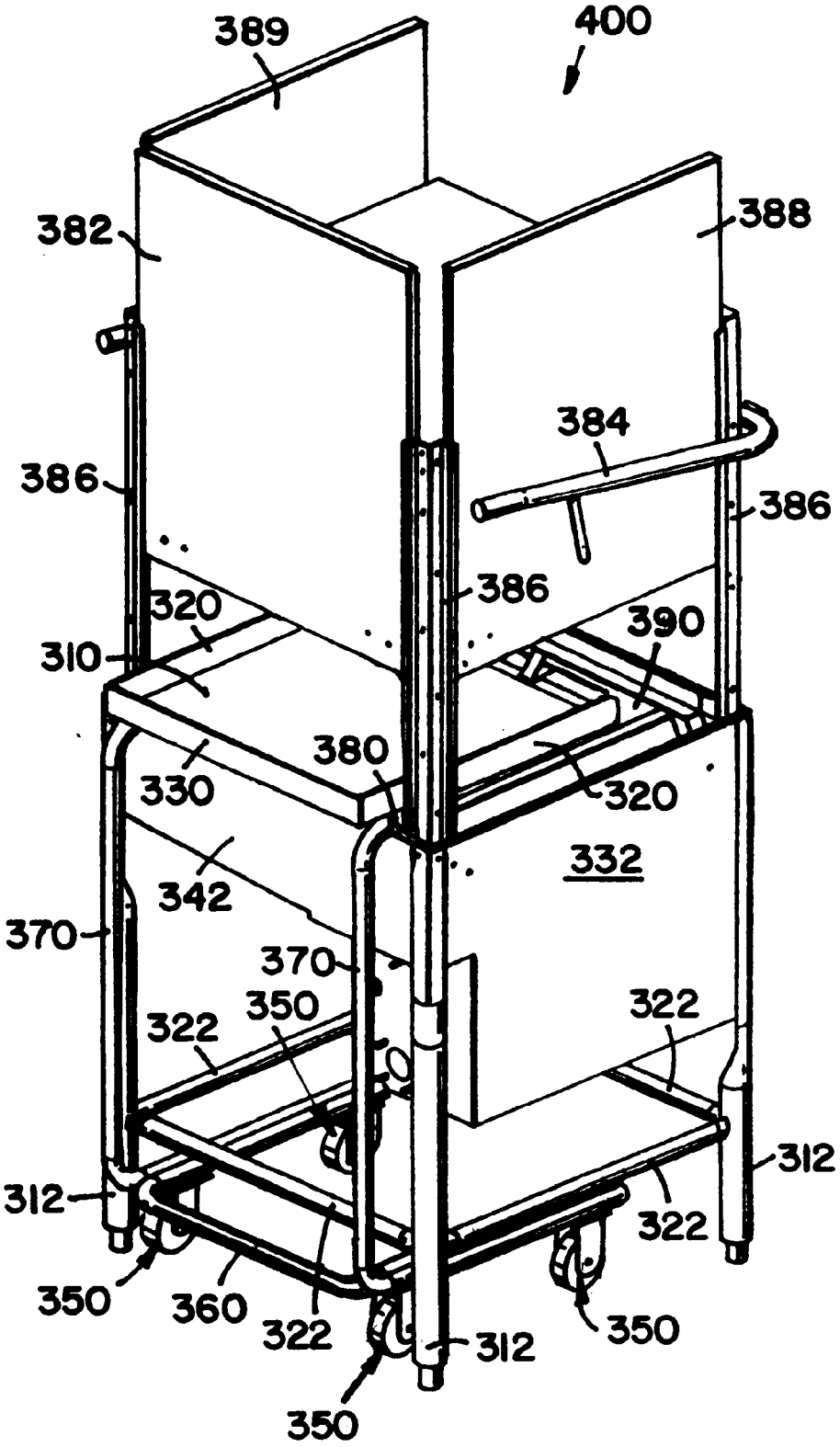
FIG. 4 is a perspective view of the invention showing the warewashing machine in combination with the cart of FIGS. 1 and 2. In this Figure, the tray or cart is shown in a storage mode. The warewashing machine can not be run with the cart in this position.

FIG. 4 is a perspective view of the warewashing assembly 400 of the invention, in which the tray or cart is seen inserted into the washing chamber 390 of the quiescent warewashing machine 300 for storage. Seen is a tray top 310, which has side fences 320, rear fence 330 and front lip 340. The tray top is attached to the remainder of the support structure via hinge or attachment assemblies 380 to the L-shaped support structures 370. The cart must be adaptable to be inserted into the chamber 390 and witdrawn to the support position of FIG. 3 or withdrawn from the machine altogether as shown in FIG. 2 with no support under edge 141. The remaining element of the support structure is horizontally orientated U-shaped support structure 360. The cart is made mobile by the addition of caster assemblies 350.

The cart support is of a height about equal to that of side panel 342 and front panel 332, allowing front lip 340 to enter into the chamber 390 of the warewashing machine. Also seen are a side door 382, back door 389 and front door 388, which also comprises a door lift handle 384. These doors, together with the side panel 342, front panel 332 and door supports 386 define the aperture into which ware racks must be placed when loaded. Another important feature of the warewashing machine involves its supports. Specifically, warewasher legs 312 and horizontal braces 322 cooperate to provide a space into which the cart can be inserted when not in use in order to conserve space, as shown in the Figure.

When the cart/tray is to be used, the cart or tray can be withdrawn from the washing chamber 390 of the warewashing machine 300. The lip 140 of the tray can be brought into close association with the support 240 of the warewashing machine for a reliable placement. Any object to be inserted into the machine or withdrawn from the machine can then be placed on the tray or cart. The flat surface 110 is ideal for introducing an object such as a rack in a slidable motion along tray 110 into the washing chamber 390 of the warewashing machine 300. As the machine 300 is operated, the doors 382, 388 and 389 can be closed to permit safe operation of the machine without removing the tray from the machine support 240. At the end of the warewashing cycle, the operations can be repeated with an object or rack for a sufficient number of cycles to complete washing of soiled objects in a shift or a daily washing regimen. When the day's work is completed, the tray or cart can be inserted into the washing chamber 390 of the warewashing machine 400 for convenience storage during quiescent periods of the machine.

The above-captioned drawings, explanation and specification describes the elements of the tray or cart, warewashing machines and objects to be washed using the cooperation between the tray or rack and the machine. While a variety of embodiments can be made without departing from the spirit and scope of the invention, the invention resides in the claims hereinafter appended.

We claim:

1. A warewashing assembly comprising a batch-loading warewashing machine and a movable cart, capable of holding a ware rack, said cart comprising a tray having a front edge, a rear edge and sides, said tray comprising side and rear fences capable of holding the ware rack against horizontal motion, said tray being held at an angle α to the horizontal of about 5° to 15°, such that the front edge is lower than the rear edge, and being of a size complementary to said ware rack, wherein the front end of the tray is placed on a support structure of the warewashing machine in such a way to, provide support for the tray; said support structure being of a suitable height to interact with the tray to accept the tray at the angle α and the cart comprises means to move horizontally in relation to the warewashing machine.

2. The warewashing assembly of claim 1 wherein the angle α is about 6° to 12°.

3. A method of accessing interior of a warewashing machine comprising the steps of:

(a) forming a warewashing assembly comprising a bach loading warewashing machine and a cart comprising a tray having a front edge and a rear edge, by resting the front edge of the tray on a support member of the warewashing machine, such that said tray is held at an angle α to the horizontal of about 5° to 15° and the front edge is lower than the rear edge;

(b) placing a ware rack onto the tray and sliding the ware rack into the interior of the warewashing machine for warewashing purposes; and (c) operating the warewashing machine with the front edge of the tray resting on the support member.

4. The method of claim 3 further comprising inserting the tray into the interior of the warewashing machine during a quiescent period.

* * * * *